United States Patent [19]

Novak et al.

[11] Patent Number: 4,534,943

[45] Date of Patent: Aug. 13, 1985

[54] APPARATUS FOR CATALYTIC REFORMING WITH CONTINUOUS SULFUR REMOVAL

[75] Inventors: William J. Novak, Guttenberg; Ronald G. McClung, Bridgewater, both of N.J.

[73] Assignee: Engelhard Corporation, Iselin, N.J.

[21] Appl. No.: 582,123

[22] Filed: Feb. 21, 1984

[51] Int. Cl.[3] ..... B01J 8/02

[52] U.S. Cl. ..... 422/188; 137/312; 208/249; 251/197; 422/115; 422/213; 422/219; 422/232; 423/230

[58] Field of Search ..... 422/115, 188, 190, 213, 422/219, 189; 208/89, 91, 249; 423/230; 251/197; 137/312

[56] References Cited

U.S. PATENT DOCUMENTS

| | | | |
|---|---|---|---|
| 3,125,323 | 3/1964 | Heinen | 251/197 |
| 3,767,563 | 10/1973 | Woodle | 208/91 |
| 4,164,544 | 8/1979 | Olsson et al. | 423/230 |
| 4,225,417 | 9/1980 | Nelson | 208/89 |
| 4,283,374 | 8/1981 | Erickson et al. | 423/230 |
| 4,329,220 | 5/1982 | Nelson | 208/89 |

*Primary Examiner*—Michael S. Marcus

[57] ABSTRACT

An apparatus for continuously removing residual sulfur from a naptha stream has a primary manganous oxide absorber, a secondary parallel manganous oxide absorber and valve and duct means for by-passing the primary absorber and directing the naptha feed stream to the secondary absorber. The apparatus also includes means for removing manganous oxide from the primary absorber and nitrogen purge means for purging the same.

1 Claim, 2 Drawing Figures

APPARATUS FOR CATALYTIC REFORMING WITH CONTINUOUS SULFUR REMOVAL

Reforming converts petroleum fractions which are normally unsuitable for automotive use into high octane gasoline by a variety of catalytic reactions including dehydrogenation, isomerization, transalkylation and cyclization which should be accomplished with as little hydrocracking as possible. Reforming is also used to produce a variety of aromatic feedstocks for the petrochemical industry. Typically, reforming is accomplished by contacting naphtha with a platinum-group metal dispersed on alumina along with a small amount of a halogen at elevated temperatures in the presence of hydrogen. Preferred platinum-group metals include platinum alone which is relatively sulfur tolerant and bi-metallic or tri-metallic combinations of platinum and other metals such as rhenium, iridium or germanium, which catalysts become increasingly sulfur intolerant as the relative amount of platinum decreases. For the bi-metallic platinum rhenium and similar catalysts, it is usually considered that the disadvantage of sulfur sensitivity is offset by the greater cycle lengths which can be obtained with these catalysts when low sulfur feeds are reformed. Most of the platinum rhenium catalysts require a sulfur content of less than 1 wppm (weight parts per million). In many operations, the sulfur level is ideally maintained at less than 0.25 or even 0.1 wppm. Much of this sulfur is conventionally removed by hydrotreating the naphtha feed to the reformer i.e. contacting the naphtha with pressurized hydrogen thus forming hydrogen sulfide gas which can be removed by physical separation means. Residual sulfur remaining after hydrotreating may be removed by passing the naphtha through an oxide bed such as manganous oxide as disclosed in U.S. Pat. Nos. 4,329,920 and 4,225,417.

As typically applied, these sulfur removal technologies have been limited by the necessity of removing the manganous oxide from its vessel after it has retained a given proportion of sulfur. In view of the extreme sulfur sensitivity of many reforming catalysts, this has required an expensive and highly undesirable shutdown of the reformer. Thus, in the past, the vessels utilized to contain these beds of manganous oxide have been sized so that the amount of manganous oxide present would be sufficient to treat all of the naphtha which would normally be processed between scheduled reformer shutdowns as are expected for catalyst regeneration and the like. Further, in the past, there have been many applications where bi-metallic catalysts could have been used to advantage but for the expense of a hydrotreater to remove sulfur from the reformer, particularly in applications where the sulfur content of the reformer feed was in the low to intermediate range i.e. 1 to 50 wppm. The method and apparatus of the present invention can be used to great advantage in eliminating the need for extremely large vessels for containing manganous oxide in conventional arrangements as well as substituting for a hydrotreater in those applications involving reforming of naphthas having low to intermediate sulfur contents. In the method of the present invention, naphtha from a hydrotreater (either alone or in conjunction with recycle hydrogen from the reformer, both being termed naphtha throughout this specification and claims) is passed through a primary bed of manganous oxide absorbent under sulfur removal conditions until the amount of sulfur passed through that first bed is equal to a predetermined fraction of the weight of that bed, say around 10%. At that point, there is a significant likelihood that deleterious amounts of sulfur will pass through the absorbent bed and come into contact with the reforming catalyst. Alternatively, for other applications, the amount of hydrogen sulfide in the recycle hydrogen from the reformer may be monitored until it reaches a predetermined level. At that time, flow of naphtha is channeled through the bypass absorber having a volume of less than ¼ of the volume of the main absorber while flow is maintained through the primary absorber. After the situation stabilizes, the flow of naphtha (or combined naphtha and hydrogen) through the primary absorber is terminated by juxtaposition and pressing of a pair of valve gates against their respective valve seats, such as provided by a double seat double gate wedge valve which is pressurized between the gates, a pair being upon either side of the primary absorber, the region between the gates being pressurized with dry nitrogen, the primary absorber is allowed to cool to about 100° C. then the primary absorber is vented to a flare to remove residual hydrogen naphtha or other hydrocarbons. Subsequently blinds are installed in each of the lines between each of the double gate wedge valves and the primary absorber, then the primary absorber is purged with nitrogen which is conducted to the flare. Upon substantially complete removal of the hydrogen, +naphtha and other hydrocarbons remaining in the primary absorber, a nitrogen purge of the primary absorber is instituted to exclude air therefrom and exhausted manganous oxide absorbent is expelled into vessels containing an inert atmosphere such as substantially oxygen-free carbon dioxide which may be conveniently maintained in the vessel by the expedient of maintaining solid carbon dioxide in the bottom of the vessel. Upon expulsion of the original charge of manganous oxide from the primary absorber, a replacement charge is installed, residual air purged from the primary absorber with dry nitrogen, the blinds removed, the system further purged, then finally, the double seat double gate wedge valves are opened, the charge in the primary absorber is conditioned with hydrogen and flow of naphtha through the primary absorber is established, and flow through the bypass absorber discontinued after the flow stabilizes.

DESCRIPTION OF THE PREFERRED EMBODIMENT

Figure 1:
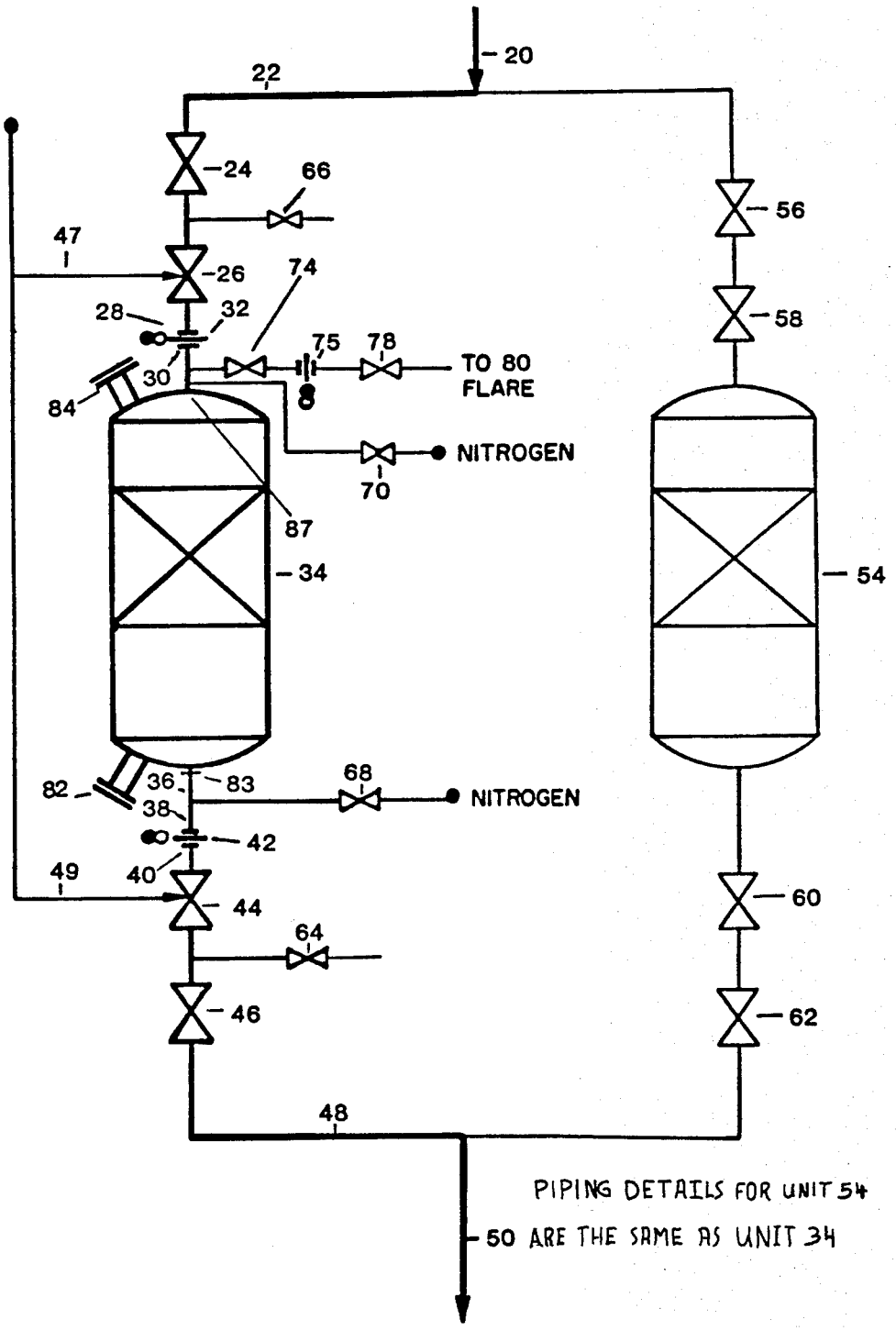
FIG. 1 is a schematic of the piping and flow control system of the present invention.

In FIG. 1, naphtha (or naphtha combined with recycle hydrogen) to have residual sulfur removed enters through line 20. In normal operation, it flows through line 22, through normally open double seat double gate wedge valves 24 and 26 (such as are manufactured by Zimmerman and Jansen GMBH of Duren, West Germany), through collars 28 and 30 having slideable open-closed blind plate 32 disposed therebetween and into absorber vessel 34 containing a charge of manganous oxide therein. After passing through the charge of manganous oxide, the product stream exits through line 36 leading through double seat double gate wedge valves 44 and 46 to line 48 and then line 50 leading (eventually) to the reformer. In practice, reforming is usually continued until from about 50 to about 300 preferably from about 80 to about 120, g of sulfur have passed through primary absorber 34 for each kilogram of manganous oxide contained therein, then hot hydrogen is passed through bypass absorber 54 to activate the change of manganous (if it has not been previously activated) oxide located therein, then normally closed double seat double gate wedge valves 56, 58, 60 and 62 are opened and naphtha is passed through both primary absorber 34 and bypass absorber 54. After bypass absorber 54 is fully stabilized, normally open double seat double gate wedge valves 24, 26, 44 and 46 are closed and a continuous bleed is initiated between valves 24 and 26 as well as between valves 44 and 46 respectively. Optionally, valves 24 and 46 may be omitted or single seat valves may be substituted therefor. If only one double seat double gate wedge valve is used upon either side of primary absorber 34, a nitrogen purge is passed through lines 47 and 49 leading to chambers 26CH and 44CH located between the gates 26G1 and 26G2 and 44G1 and 44G2 of valves 26 and 46 respectively. Even if both sets of the preferred valves are used throughout, it is often desirable to apply continuous nitrogen purge between gates 26G1 and 26G2 as well as gates 44G1 and 44G2 of valves 26 and 44 respectively. Subsequently, valve 68 is opened and a purge of nitrogen is passed through primary reactor 34 to flare 80.

Figure 2:
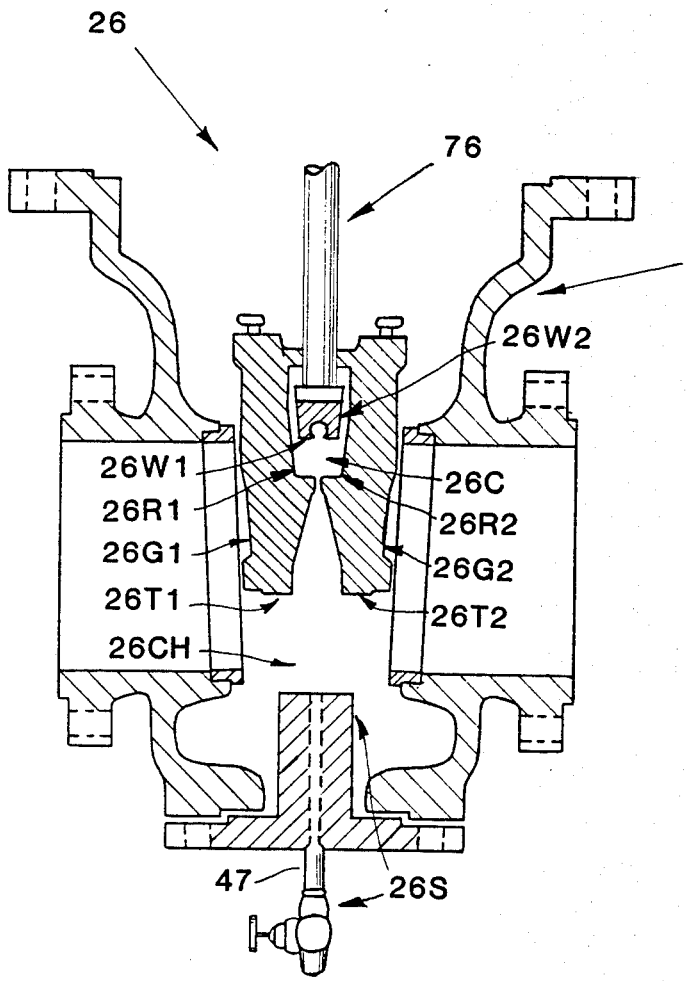
FIG. 2 is a sectional view of the double seat double gate wedge valves used in the present invention.

In FIG. 2, as actuator rod 76 of valve 26 is lowered, gates 26G1 and 26G2 are forced downward until tips 26T1 and 26T2 contact stop 26S located in the lower portion of chamber 26CH of valve 26. As actuator rod 76 is lowered further, wedgeblocks 26W1 and 26W2, slideably disposed within cavity 26C engage inclined ramp surfaces 26R1 and 26R2 on gates 26G1 and 26G2, respectively and force gates 26G1 and 26G2 to move outwardly and engage seats 26S1 and 26S2, respectively. Nitrogen purge is applied to chamber 26CH between gates 26G1 and 26G2 through line 47. The use of double seat double gate wedge valves of the type described is very advantageous as it enables a line in contact with high temperature, high pressure flowing naphtha to be repeatedly opened to the atmosphere without endangering workers in the opened section and without releasing dangerous pollutants to the atmosphere. Valve 44 is of the same construction as valve 26.

After complete isolation of primary absorber 34, it is allowed to cool until its temperature reaches about 100° C. Blind 75 is opened while valves 74 and 78 are closed, then valves 74 and 78 are opened allowing primary absorber 34 to be vented to flare 80 to remove residual hydrogen, naphtha and other hydrocarbons remaining in primary absorber 34. Thereafter, valve 68 is opened and nitrogen is forced through primary absorber 34 and thence to flare 80. After primary absorber 34 and the lines leading thereto are substantially free of any noxious substances, valves 68, 74 and 78 are closed. After the concentration of naphtha in primary absorber 34 has been reduced to a safe level, blind plates 32 and 42 are repositioned to replace annular portions 32A and 42A of blind plates 32 and 42 with disc portions 32D and 42D between collars 28 and 30 and 38 and 40 respectively, thus further sealing primary chamber 34 from naphtha contained in lines 22 and 48, valve 70 is opened to provide a continuous nitrogen purge during unloading. Exhaust port 82 is opened and exhausted manganous oxide is expelled therefrom into vessels (not shown) having an inert atmosphere such as substantially oxygen-free carbon dioxide conveniently maintained therein by the presence of a sufficient amount of dry ice also located therein. Alternatively, the exhausted manganous oxide may be discharged through exit port 83 of primary absorber 34. After exhaust port 82 (or alternatively, exit port 83) has been resealed, a new charge of manganous oxide may be introduced into primary absorber 34 through loading port 84 or inlet nozzle 87. Upon completion of charge introduction into primary absorber 34, valves 68 and 70 remain open and any residual air in primary absorber 34 is expelled with dry nitrogen. Thereafter, blind plates 32 and 42 are repositioned to locate annular regions 32A and 42A between collars 28 and 30 and 38 and 40 respectively. With valves 74 and 78 closed, blind 75 is installed in line 81, valves 24, 26, 44 and 46 are opened, the charge of manganous oxide is activated, and naphtha is passed through primary absorber 34. After the flow has stabilized, valves 56, 58, 60 and 62 are closed, the bypass absorber is removed from the system until the primary absorber is to again be removed from the system temporarily. Advantageously, the volume of bypass absorber 54 will be no more than $\frac{1}{4}$, preferably 1/10, of the volume of primary absorber 34 and the overall system will be sized so that the charge in the primary absorber is changed from about 2 to about 5 times between each scheduled reformer shutdown such as those planned for regeneration. It will be apparent that in the case of system upset wherein a large quantity of relatively high sulfur naphtha manages to penetrate the hydrotreater, an unscheduled charge replacement on the primary absorber may be performed without discontinuing reforming whereas an unscheduled shutdown might be required if a normal single absorber system were used. Further, since the capital cost of a relatively small absorber is less than that of a hydrotreater, in many circumstances, as for instance, when low to intermediate sulfur feeds are to be reformed (i.e. from about 1 to about 50 wppm sulfur) by means of the present invention, it is possible to make two absorbers fulfill the function normally fulfilled by the much more expensive hydrotreater at an extremely significant capital savings.

Two primary means may be used to determine when the charge in the primary absorber is to be replaced. In the preferred method, the absorber charge is replaced when the total amount of sulfur which has passed through it is from about 5% to about 30% preferably from about 8% to about 12% of the weight of the manganous oxide in the charge. However, it is possible to monitor the level of hydrogen disulfide in the hydrogen recycle from the reformer and replace the charge when that level exceeds a predetermined level.

We claim:

1. An apparatus for removing residual sulfur from naphtha to be fed to a reformer comprising:

a primary absorber having a charge of manganous oxide disposed therein; a bypass absorber having a charge of manganous oxide disposed therein; the volume of the bypass absorber being no more than about one-fourth the volume of the primary absorber; entrance duct means for passing naphtha through said primary absorber, said entrance duct means having at least one entrance seal double seat double gate wedge valve means disposed therein for interrupting flow through said primary absorber and at least one entrance seal collar means mounted on said entrance duct means adapted to receive a blind seal plate means mountable thereon locatable in said entrance duct means between said primary absorber and said entrance seal double seat double gate wedge valve means; exit duct means for withdrawing desulfurized naphtha from said primary absorber, said exit duct means having at least one exit seal double seat double gate wedge valve means disposed therein for interrupting flow through said primary absorber and at least one exit seal collar means mounted on said exit duct means adapted to receive a blind seal plate means mountable thereon locatable in said exit duct means between said primary absorber and exit seal double seat double gate wedge valve means; flare means operably associated with said primary absorber; means for passing nitrogen through said primary absorber to said flare means and purging said primary absorber when said entrance seal and exit seal double seat double gate wedge valve means are closed and said entrance seal and exit seal collar means each have blind seal plate means mounted thereon; means for supplying a nitrogen purge between the gates of each of said entrance seal and exit seal double seat double gate wedge valve means and urging each of said gates against its respective seat; means for withdrawing manganous oxide from said primary absorber into vessels having an inert atmosphere therein; and means for diverting flow of naphtha through said bypass absorber while said entrance seal and exit seal double seat double gate wedge valve means are in their closed position.

* * * * *